US006470310B1

(12) United States Patent
Oshikiri et al.

(10) Patent No.: US 6,470,310 B1
(45) Date of Patent: Oct. 22, 2002

(54) METHOD AND SYSTEM FOR SPEECH ENCODING INVOLVING ANALYZING SEARCH RANGE FOR CURRENT PERIOD ACCORDING TO LENGTH OF PRECEDING PITCH PERIOD

(75) Inventors: Masahiro Oshikiri; Kimio Miseki, both of Hyougo-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/407,060

(22) Filed: Sep. 28, 1999

(30) Foreign Application Priority Data

Oct. 8, 1998 (JP) ..... 10-286738

(51) Int. Cl.[7] ..... G10L 11/04; G10L 19/14
(52) U.S. Cl. ..... 704/207; 704/205; 704/206
(58) Field of Search ..... 704/220, 223, 704/222, 219, 233, 226, 207

(56) References Cited

U.S. PATENT DOCUMENTS 5,602,961 A * 2/1997 Kolesnik et al. ..... 704/223
5,664,055 A * 9/1997 Kroon ..... 704/223
5,819,213 A * 10/1998 Oshikiri et al. ..... 704/222
5,909,663 A * 6/1999 Iijima et al. ..... 704/222
6,003,001 A * 12/1999 Maeda ..... 704/223
6,202,046 B1 * 3/2001 Oshikiri et al. ..... 704/226

FOREIGN PATENT DOCUMENTS

JP 2000-112498 * 4/2000 ..... G10L/19/00

OTHER PUBLICATIONS

Mei Yong, et al., "Efficient Encoding Of The Long–Term Predictor In Vector Excitation Coders," Advances in Speech Coding, Kluuer Academic Publishers, (1991) pp. 329–338.

Joseph P. Campbell, et al., "An Expandabe Error–Protected 4800 BPS CELP Coder", Proceedings of the IEEE ICASSP, (1989), pp. 735–738.

Erdal Paksoy, et al., "A Variable–Rate Multimodal Speech Coder With Gain–Matched Analysis –by–Synthesis", Proceedings of the IEEE IGASSP, (1997), pp. 751–754.

* cited by examiner

*Primary Examiner*—Richemond Dorvil
*Assistant Examiner*—Dan Nolan
(74) *Attorney, Agent, or Firm*—Oblon, Spivak, McClelland, Maier & Neustadt, P.C.

(57) ABSTRACT

Processing for producing encoded output representing information about a pitch period of an input speech signal is performed. The pitch period of a previously entered speech signal is stored in a buffer. A search range-determining portion determines a range in which a current pitch period is analyzed, according to the pitch period of the previously entered speech signal. A presently entered speech signal is applied from a speech input terminal. A pitch analysis portion makes a pitch analysis of candidates for the pitch period contained in the determined search range. Information about the pitch period is delivered from an output terminal and stored in the buffer for subsequent processing. The pitch period of the speech signal can be calculated with a small amount of calculation and represented with a small amount of information.

12 Claims, 10 Drawing Sheets

WHERE PITCH PERIOD Lprv OF PREVIOUS SUBFRAME IS SHORT

WHERE PITCH PERIOD Lprv OF PREVIOUS SUBFRAME IS LONG

METHOD AND SYSTEM FOR SPEECH ENCODING INVOLVING ANALYZING SEARCH RANGE FOR CURRENT PERIOD ACCORDING TO LENGTH OF PRECEDING PITCH PERIOD

BACKGROUND OF THE INVENTION

1. Field of the Invention

The present invention relates to a speech encoding method for encoding and compressing speech signals and, more particularly, to processing for encoding information about the pitch period that is one of encoding parameters in speech encoding.

2. Description of the Related Art

Techniques for encoding and compressing speech signals at low bit rates efficiently are important in making effective use of electromagnetic waves and in reducing the communications costs in mobile communications such as mobile cellular phones and in LAN communications.

Code-excited, linear prediction (CELP) is known as a speech encoding method capable of synthesizing high-quality decoded speech at low bit rates of less than 8 kbps. This CELP technique has been published by M. R. Schrodeder and B. S. Atal in "Code-Excited Linear Prediction (CELP) High-Quality Speech at Very Low Bit Rates", Proc. ICASSP: 1985, pp. 937–939 (hereinafter referred to as reference 1). Since then, this technique has attracted attention as a method capable of synthesizing high-quality speech. Various discussions have been made to improve the quality and to decrease the amount of calculation.

An adaptive codebook is available as a component necessary for speech encoding using CELP. The adaptive codebook performs a pitch prediction analysis of an input signal by a closed-loop operation or by analysis-by-synthesis. Generally, pitch prediction analysis using an adaptive codebook searches a search area (containing 128 candidates) of 20–147 samples for pitch periods, and finds such a pitch period that minimizes the distortion of a target signal. Often, information about the pitch period is transmitted as 7-bit encoded data.

In the conventional CELP method described above, the pitch period is determined by a closed-loop operation in each subframe. Therefore, where the search area of pitch periods contains as many as 128 candidates, the amount of calculation becomes exorbitant. With this indirect search method for searching for pitch period, information about the pitch period needs 7 bits per subframe. Assuming that 1 frame is composed of 4 subframes, as many as 28 bits are necessary per frame.

Intrinsically, many portions of the pitch periods of speech signals vary mildly. It is not necessary to perform full search in each subframe. Utilizing these properties of the pitch periods, the amount of calculation is reduced. Also, the number of bits can be decreased. In view of these facts, a method using a differential pitch expression for limiting the search area for pitch periods has been reported.

One method is to search for every candidate in odd-numbered subframes in searching for pitch periods. In even-numbered subframes, only candidates close to the odd-numbered subframes are sought. This reduces the amount of calculation and the number of bits, as reported by J. P Campbell Jr. et al. in "An Expandable Error-Protected 4800 bps CELP Coder (U.S. Federal Standard 4800 bps Voice Coder)", Proc. ICASSP; 1989, pp. 735–738 (hereinafter referred to as reference 2). In this method, with respect to odd-numbered subframes, all 128 candidates are sought. With respect to even-numbered subframes, the candidates are limited to 32, for example, based on the previous subframe, and then pitch periods are sought. This can reduce the amount of calculation necessary for search for pitch periods. With respect to evennumbered subframes, if it is assumed that pitch periods are selected from 32 candidates, information about each pitch period can be represented by 5 bits. As a result, where the number of subframes is 4, the amount of information about pitch periods per frame can be reduced to 24 bits.

With this method, however, if a value widely different from an actual pitch period is selected as the pitch period found in an odd-numbered subframe, the next subframe will be affected. Consequently, the decoded speech will be perceivably deteriorated. Accordingly, where the range searched to find the pitch period of the present subframe is determined, based on the pitch period found in the previous subframe, it is important to determine the search range for pitch period so as not to incur deterioration of the quality of the decoded speech. For this purpose, the search range may be enlarged. With this method, however, neither the amount of calculation nor the number of bits representing the information about the pitch period can be reduced sufficiently.

In the CELP method that is the conventional speech encoding method, the pitch period is found by closed-loop search in each subframe as mentioned above. Therefore, the amount of calculation necessary to find the pitch period becomes exorbitant. In addition, the number of bits increases, the bits representing information about the pitch period that is encoded data.

Where the pitch period is found by limiting the pitch period search range as described in reference 2, the amount of calculation to find the pitch period decreases. Furthermore, the number of bits representing information about the pitch period decreases. However, if a value widely different from the actual pitch period is selected in an odd-numbered subframe, the next subframe is affected. In consequence, the decoded output speech is deteriorated perceivably. If the search range is enlarged to prevent this, neither the amount of calculation nor the number of bits representing information about the pitch period can be reduced sufficiently.

SUMMARY OF THE INVENTION

The present invention has been made to solve the foregoing problems with the prior art technique.

It is an object of the present invention to provide a method and system for precisely finding the pitch period of a speech signal with a small amount of calculation and for representing the pitch period with a small amount of information.

This object may be accomplished, for example, by a speech encoding method for encoding an input speech signal in accordance with its pitch period. The method involves reading a pitch period of a previously entered speech signal, and determining a search range for a presently entered speech signal based on a length of the pitch period of the previously entered speech signal. The method further involves finding a pitch period of the presently entered input speech signal based on the search range, and encoding the pitch period of the presently entered input speech signal. In this manner, the pitch period of the speech signal is determined with minimal calculation, and the pitch period is represented with a small amount of information.

Other objects and features of the invention will appear in the description thereof, which follows.

DETAILED DESCRIPTION OF THE PREFERRED EMBODIMENTS

Figure 1:
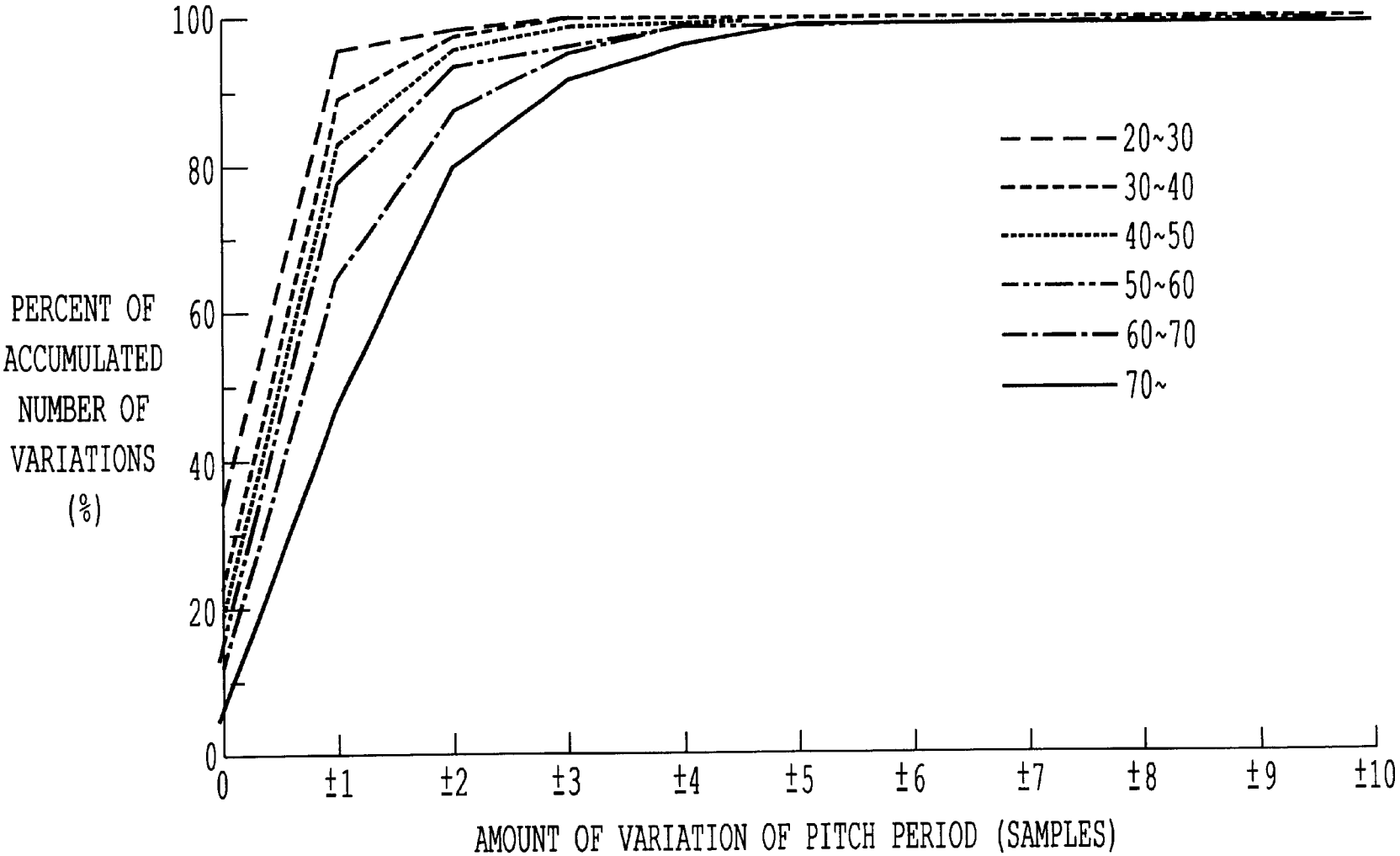
FIG. 1 is a diagram in which the percent of accumulated number of variations of the pitch period between adjacent subframes of an input speech signal is plotted against the amount of variation of the pitch period for various values of the pitch period of the previous subframe, illustrating the fundamental principle of the present invention.

The objects of the invention may be achieved in accordance with a variety of methods and systems.

A speech encoding method for encodes an input speech signal in accordance with its pitch period. The method involves reading a pitch period of a previously entered speech signal, and determining a search range for a presently entered speech signal based on a length of the pitch period of the previously entered speech signal. The method further involves finding a pitch period of the presently entered input speech signal based on the search range, and encoding the pitch period of the presently entered input speech signal.

For example, where the input speech signal is divided into a plurality of frames of a given length and each frame is divided into a plurality of subframes and processed, the present invention makes use of the correlation between the length of the pitch period of the previous subframe and the amount of variation of the pitch period between adjacent subframes to determine the search range for the pitch period of the present subframe according to the pitch period found in the previous subframe. In particular, where the pitch period found in the previous subframe is long, the search range for the pitch period of the present subframe is enlarged. Conversely, where the pitch period found in the previous subframe is short, the search range for the pitch period of the present subframe is narrowed. This can reduce the amount of calculation necessary for search for pitch period. Also, the quality of the decoded speech can be improved.

The present invention also provides a method of encoding an input speech signal, the method involving processing for producing an output signal representing information about the pitch period of the input speech signal. This method comprises the steps of dividing the input speech signal into a plurality of frames of a predetermined length and dividing each frame of the speech signal into a plurality of subframes; determining a search range searched to find the pitch period of a present subframe, according to the length of the pitch period found in a previous subframe prior to the present subframe; taking an adaptive vector from an adaptive codebook according to the pitch period of the present subframe; and passing the taken adaptive vector through a synthesis filter searching the adaptive vector that minimizes a difference between an output signal from the synthesis filter and a target vector and encoding the found adaptive vector.

In determining the search range, if the pitch period found in the previous subframe is long, the search range for adaptive vectors in the adaptive codebook. That is, the search range for the pitch period of the present subframe is enlarged. Conversely, if the pitch period found in the previous subframe is short, the search range is narrowed. Hence, the amount of calculation for the search can be reduced. Also, the quality of the decoded speech can be improved.

In another feature of the present invention, the deviation of the pitch period of the present subframe from the pitch period found in the previous subframe is calculated, and this amount of deviation is encoded as information about the pitch period of the present subframe.

Where information about the pitch period of the present subframe is represented with the same amount of code irrespective of the length of the pitch period of the previous subframe, pitch period candidates that would not be selected at all where the pitch period of the previous subframe is short may appear, or amounts of deviation greater than a forecast amount of deviation where the pitch period of the previous subframe is short may appear. In this way, the quality of the decoded speech may deteriorate.

In contrast, in the present invention, where the pitch period of the previous subframe is short, the amount of difference in pitch period between the previous subframe and the present subframe is small and so when a search is made for the pitch period of the present subframe based on the pitch period of the previous subframe, the search range is narrowed. The intervals between pitch period candidates sought are narrowed accordingly. This eliminates wasteful search for pitch period candidates. Conversely, where the pitch period of the previous subframe is long, the range searched to find the pitch period of the present subframe based on the pitch period of the previous subframe is enlarged. The intervals between the pitch period candidates sought are widened accordingly. In this way, the method can cope with large variations in pitch period.

In this manner, the quality of the decoded speech is improved. The amount of information about the pitch period can be effectively reduced by encoding the amount of deviation of the pitch period of the present subframe from the pitch period found in the previous subframe.

In a further feature of the invention, pitch period candidates sought are arranged as follows in finding the pitch period of the present subframe. Those candidates having pitch periods closer to the pitch period found in the previous subframe are spaced closely. Those candidates having pitch periods widely different from the pitch period found in the previous subframe are spaced more widely. As can be seen from FIG. 1, the pitch period of the present subframe appears at a higher probability at a position closer to the pitch period of the previous subframe. This tendency becomes more conspicuous as the pitch period of the previous subframe shortens. Therefore, the quality of the decoded speech is improved further by placing the pitch period candidates closely where they are close to the pitch period of the previous subframe and widely where they are widely different from the pitch period of the previous subframe rather than uniformly arranging the pitch period candidates in the present subframe within the search range given.

In this case, the quality of the decoded speech is enhanced further by varying the intervals between the candidates according to the length of the pitch period of the previous subframe. If the previous subframe has a short pitch period, the quality of the decoded speech can be improved by narrowing the search range to decrease the interval between sought candidates or by enlarging the range of the closely spaced candidates.

The present invention also provides a speech encoding system designed to employ the speech encoding method described above. This speech encoding system has a means for producing an encoded output signal representing information about the pitch period of an input speech signal. This system includes a search range-determining means, a pitch analysis portion, and a buffer for storing information about the found pitch period. The search range-determining portion determines a range in which the pitch period of the present input speech signal is analyzed, according to the length of the pitch period of a past input speech signal produced prior to the present input speech signal. The pitch analysis portion finds the pitch period of the present input speech signal by analysis from the search range described above.

The present invention provides another speech encoding system having a means for producing an encoded output signal representing information about the pitch period of an input speech signal. This speech encoding system comprises a frame -and-subframe forming portion, a search area-determining portion, and a pitch period-calculating portion for finding the pitch period of each subframe from the search range. The frame-and-subframe forming portion divides the input speech signal into frames of a predetermined length and divides each frame of the input speech signal into subframes. The search area-determining portion determines a range searched to find the pitch period of the present subframe, according to the length of the pitch period found in the previous subframe that is prior to the present subframe to be encoded. The pitch periodcalculating portion finds the pitch period of each subframe from the search range.

The search range-determining portion may determine the search range for adaptive vectors taken from an adaptive codebook about the present subframe, according to the length of the pitch period found in the previous subframe that is prior to the present subframe to be encoded.

The pitch period-calculating portion may search the search range for an adaptive vector having a period that minimizes the error (difference) between a signal and a target vector, the signal being obtained by passing an adaptive vector taken from the adaptive codebook through a synthesis filter.

The pitch period-calculating portion may produce encoded output signal representing information about the adaptive vectors found by the search described above.

The present invention provides a further speech encoding system for producing encoded output signal representing information about the pitch period of an input speech signal. This system comprises a frame-and-subframe forming means, a search range-determining means, a first multiplier, a second multiplier, an adder, a subtractor, and a distortion-calculating portion. The frame-and-subframe forming means divides the input speech signal into frames of a predetermined length and divides each frame of the input speech signal into subframes. An adaptive vector is taken from an adaptive codebook about the present subframe. The search range-determining means determines a range searched to find this adaptive vector according to the length of the pitch period found in the previous subframe that is prior to the present subframe to be encoded. The first multiplier produces the product of the adaptive vector taken from the search range and an adaptive vector gain selected from an adaptive vector gain codebook. The second multiplier produces the product of a stochastic vector selected from a stochastic codebook and a stochastic vector gain selected from a stochastic vector gain codebook. The adder produces the sum of the output signal from the first multiplier and the output signal from the second multiplier and creates an excitation vector. The excitation vector is passed through a weighting synthesis filter to produce a synthesis vector. The input speech signal is passed through a perceptual weighting filter to produce a target vector. The subtractor produces the difference between the synthesis vector and the target vector. The search distortion-calculating portion searches for a combination of the adaptive vector, adaptive vector gain, stochastic vector, and stochastic vector gain that minimizes the distortion found from the signal from the subtractor.

The preferred embodiments of the present invention are hereinafter described by referring to the accompanying drawings.

The concept of the present invention is first described by referring to FIG. 1, in which an input speech signal is divided into frames of a given length. Each frame is divided into subframes.

FIG. 1 is a diagram in which the percent of accumulated number of variations of the pitch period between adjacent subframes of an input speech signal is plotted against the amount of variation of the pitch period. Speech data produced from plural talkers persisted for about 200 seconds. The speech data was sampled at 8 kHz. Only results arising from those portions which can be regarded as voiced steady intervals are shown. Plotted on the horizontal axis is the amount of variation (in samples) of the pitch period of the present subframe to be encoded, i.e., the amount of deviation of the pitch period of the present subframe from the pitch period of the previous subframe. Plotted on the vertical axis is the percent of the accumulated number of variations of the-pitch period.

Six curves corresponding to various values of the pitch period of the previous subframe are shown in FIG. 1. For example, a graph located at the highest position indicates the percent of the accumulated number of variations of the pitch period where the pitch period of the previous subframe is 20 to 30 samples. The underlying curves indicate the results where the pitch period of the previous subframe is 30–40 samples, 40–50 samples, 50–60 samples, 60–70 samples, and more than 70 samples, respectively.

Where the pitch period of the previous subframe is as short as 20 to 30 samples as shown in FIG. 1, the pitch period of the present subframe is contained within ±4 samples almost completely (nearly 100%). As the pitch period of the previous subframe is prolonged, the amount of variation between the pitch period of the previous subframe and the pitch period of the present subframe tends to increase. Especially when the pitch period of the previous subframe exceeds 70 samples, the amount of variation of the pitch period can even be ±10 samples.

Figure 2:
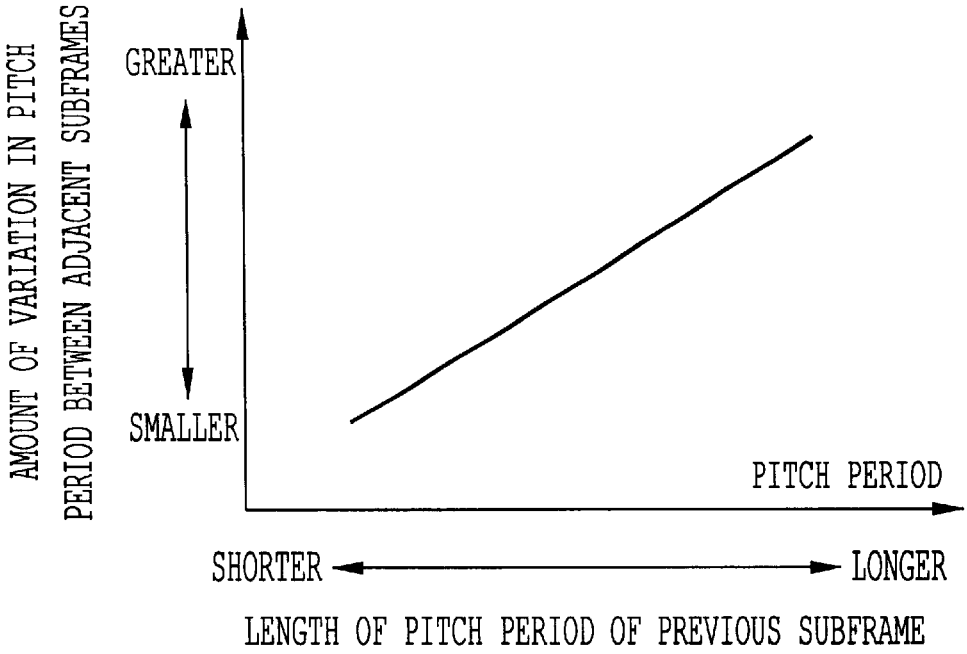
FIG. 2 is a diagram illustrating the correlation between the length of the pitch period of the previous subframe of an input speech signal and the amount of variation of the pitch period between adjacent subframes, illustrating the fundamental principle of the present invention.

As can be seen from these results, a correlation exists between the length of the pitch period of the previous subframe and the amount of variation in pitch period between adjacent subframes (i.e., between the previous subframe and the present subframe). FIG. 2 depicts the relation between the length of the pitch period of the previous subframe and the amount of variation in pitch period between adjacent subframes.

Utilizing the aforementioned correlation between the length of the pitch period of the previous subframe and the amount of variation in pitch period between adjacent subframes, the range searched to find the pitch period of the present subframe is determined according to the length of the pitch period found in the previous subframe. In particular, if the pitch period found in the previous subframe is long, the search range to find the pitch period of the present subframe is enlarged. Conversely, if the pitch period found in the previous subframe is short, the range searched to find the pitch period of the present subframe is narrowed. This can reduce the amount of calculation for search for the pitch period. Also, the quality of the decoded speech can be improved.

First Embodiment

Figure 3:
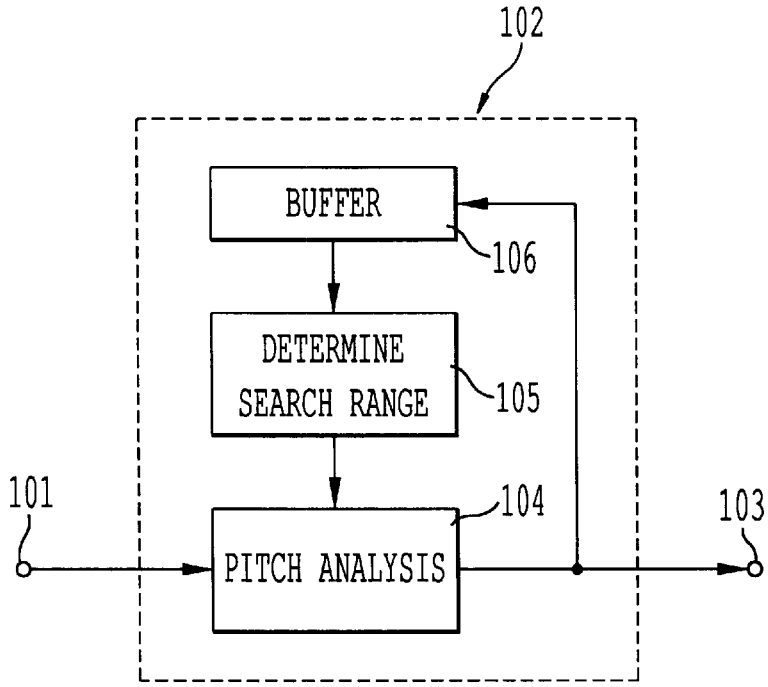
FIG. 3 is a circuit diagram of a pitch period-calculating portion of a speech-encoding system utilizing a speech encoding method in accordance with a first embodiment of the present invention.

FIG. 3 shows a structure in accordance with a first embodiment of the present invention. An input speech signal is applied to a speech input terminal 101 and supplied to a pitchcalculating portion 102. This calculating portion 102 calculates the pitch period existing within the input speech signal and produces an encoded output signal from an encoded data output terminal 103, the output signal representing information about the pitch period. The pitch-calculating portion 102 comprises a pitch analysis portion 104, a pitch period search ranged-determining portion 105, and a buffer 106.

Figure 4:
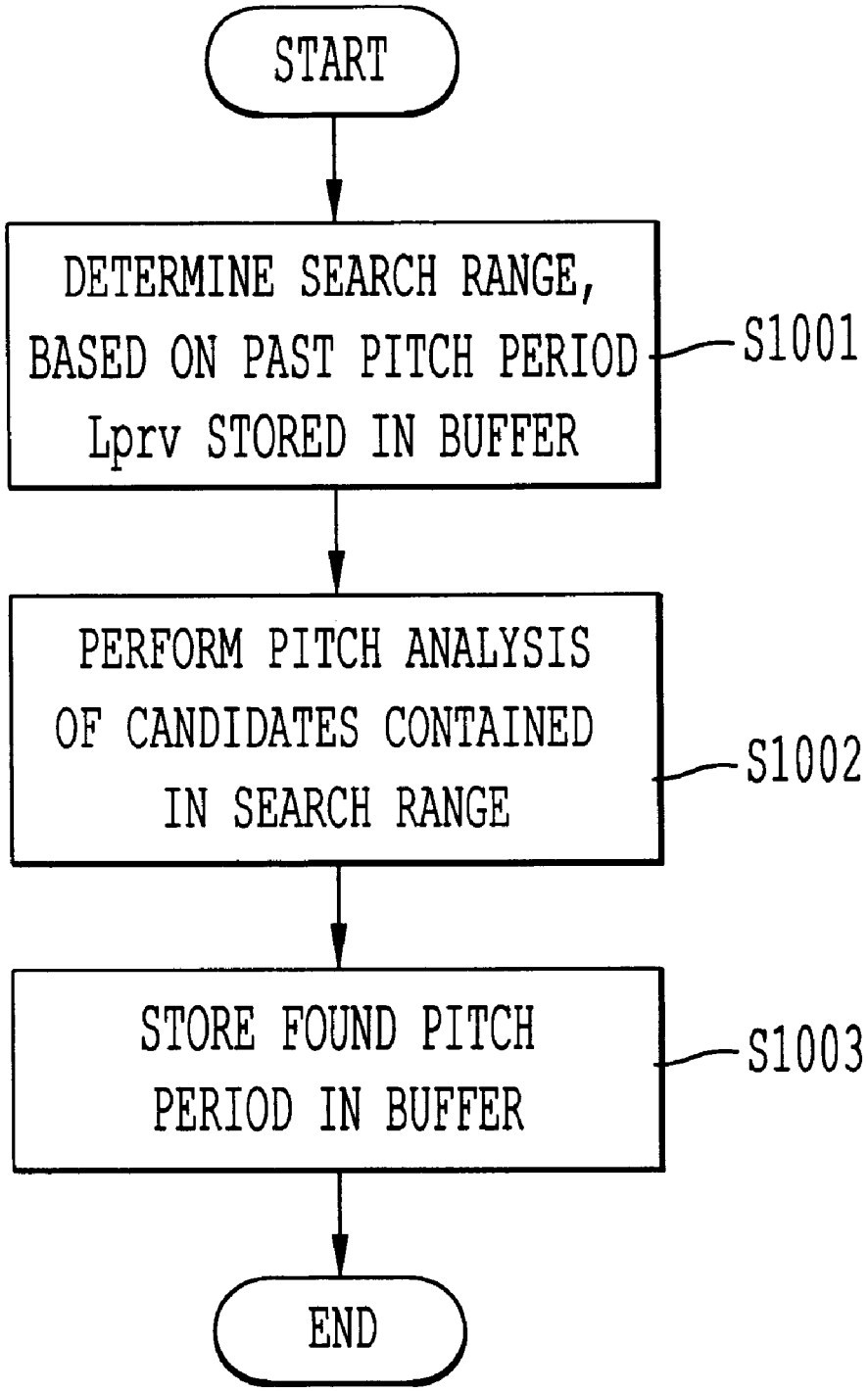
FIG. 4 is a flowchart illustrating the processing performed by the pitch period-calculating portion shown in FIG. 3.

The flow of the processing performed by the pitch-calculating portion 102 is described now by referring to the flowchart of FIG. 4. Information about past pitch period Lprv was produced from the encoded data output terminal 103 and is stored in the buffer 106. The pitch period search range-determining portion 105 determines a range in which the pitch period is analyzed, based on the past pitch period Lprv (step 1001).

Then, the pitch analysis portion 104 analyzes the pitch period (pitch analysis) about pitch candidates contained in the search range determined in step 1001. The pitch period L is found (step 1002). Information about this pitch period L is produced from the encoded data output terminal 103. As a method of pitch analysis, the pitch period can be found by correlation analysis of either the input speech signal or a residual signal produced by LPC prediction.

Finally, information about the pitch period L found by the pitch analysis portion 104 in step 1002 is stored as information about the past pitch period Lprv in the buffer 106 for preparation of the next processing (step 1003).

Figure 5A:
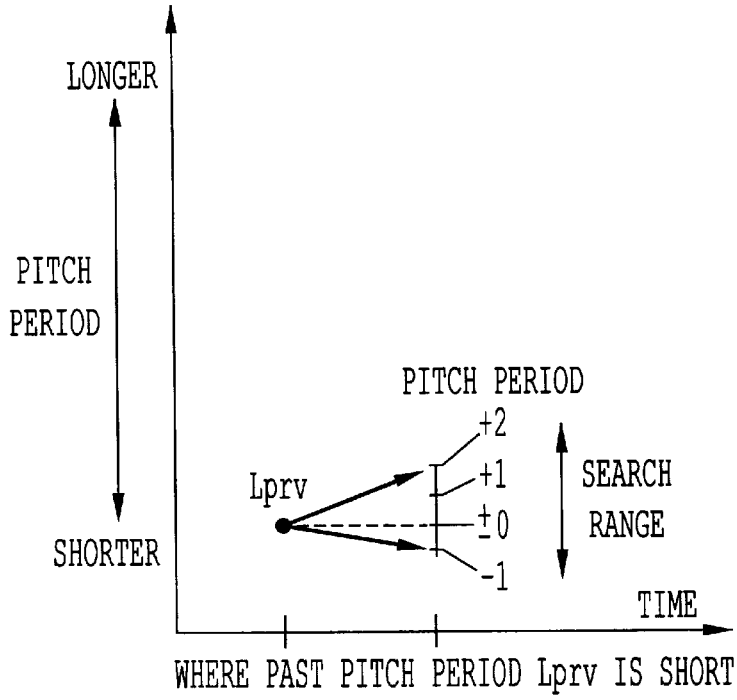
FIGS. 5(*a*) and 5(*b*) are diagrams illustrating a method of determining an analysis search range for pitch period by a search range-determining portion of the speech-encoding system utilizing the speech encoding method in accordance with the first embodiment of the invention.
Figure 5B:
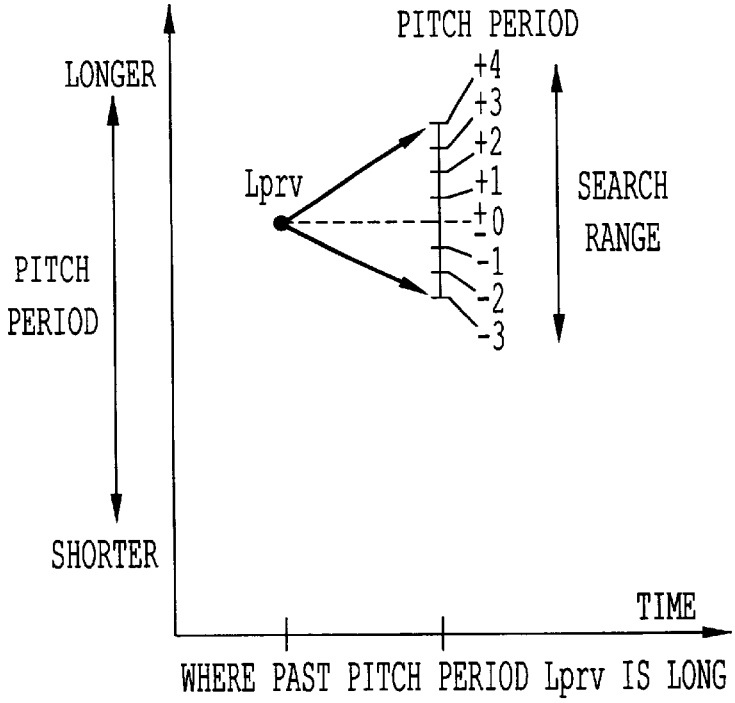

The pitch period search range-determining portion 105 is described in detail by referring to FIGS. 5(*a*) and 5(*b*). FIG. 5(*a*) shows the pitch period search range (search range) in a case in which the past pitch period Lprv is short. FIG. 5(*b*) shows the pitch period search range (search range) in a case in which the past pitch period Lprv is long.

Where the past pitch period Lprv is short, the amount of variation of the pitch period is small and so if the search range is set to a narrow range of −1 to +2 samples, for example, as shown in FIG. 5(*a*), it is possible to search for the pitch period. Conversely, where the past pitch period Lprv is long, the amount of variation of the pitch period is large. Therefore, the search range can be set to a wide range of −3 to +4 samples, for example, as shown in FIG. 5(*b*).

In this way, in the present embodiment, the pitch period search range is determined according to the length of the past pitch period Lprv. Consequently, the average amount of calculation necessary for analysis of pitch period can be reduced. Also, the quality of decoded speech can be improved.

Second Embodiment

Figure 6:
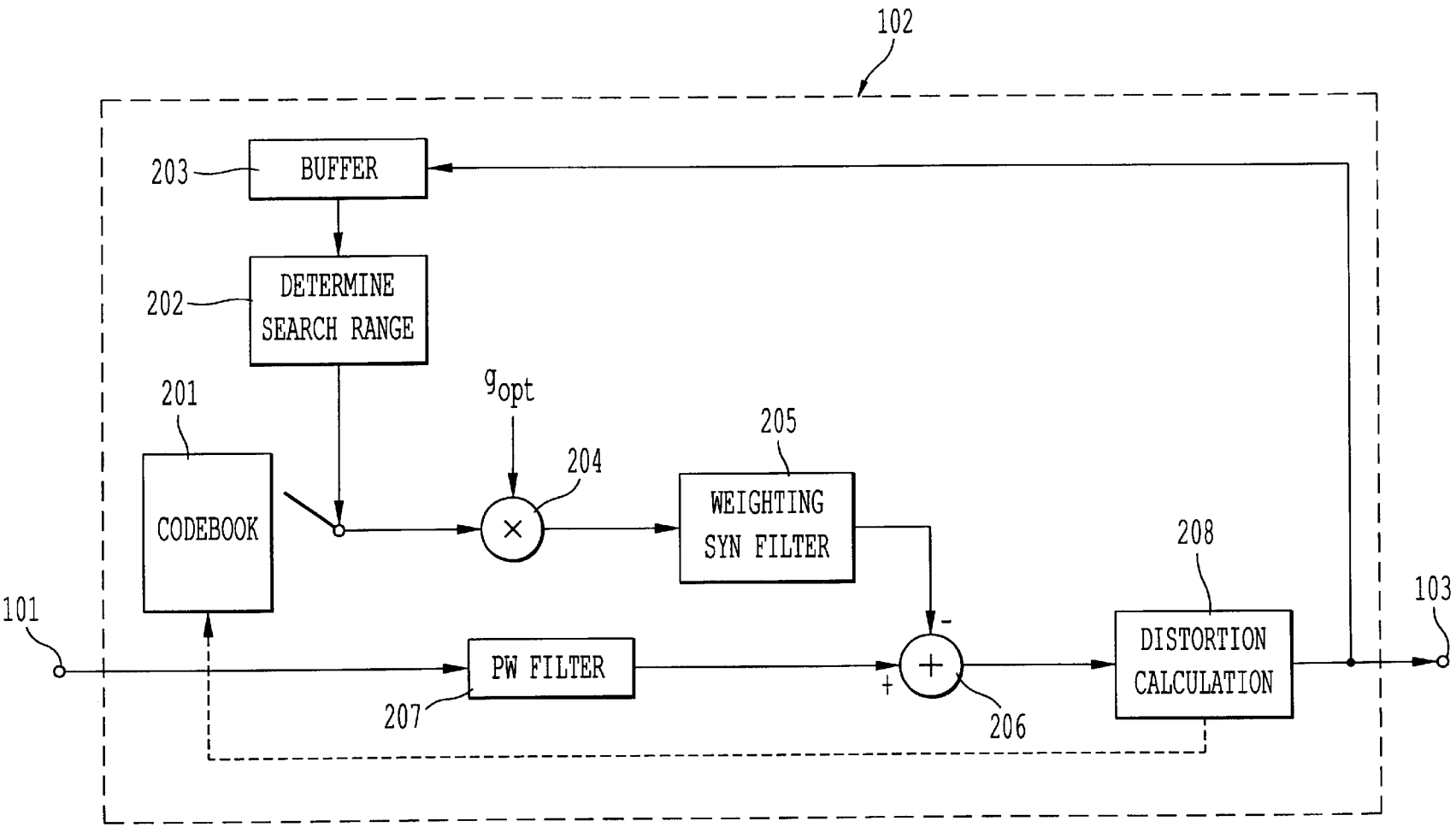
FIG. 6 is a block diagram of a pitch period-calculating portion of a speech-encoding system utilizing a speech encoding method in accordance with a second embodiment of the invention.

FIG. 6 shows the structure of the pitch-calculating portion 102 in accordance with a second embodiment of the invention. An adaptive codebook is used for analysis of pitch periods. Past excitation signal sequences are generated repeatedly at intervals contained in a predetermined range, thus producing plural adaptive vectors which are stored in the adaptive codebook. That is, the pitch period-calculating portion 102 in accordance with the present embodiment comprises an adaptive codebook 201, a search range-determining portion 202, a buffer 203, a multiplier 204, a weighting synthesis filter 205, a subtractor 206, a perceptual weighting filter 207, and a distortion-calculating portion 208.

Figure 7:
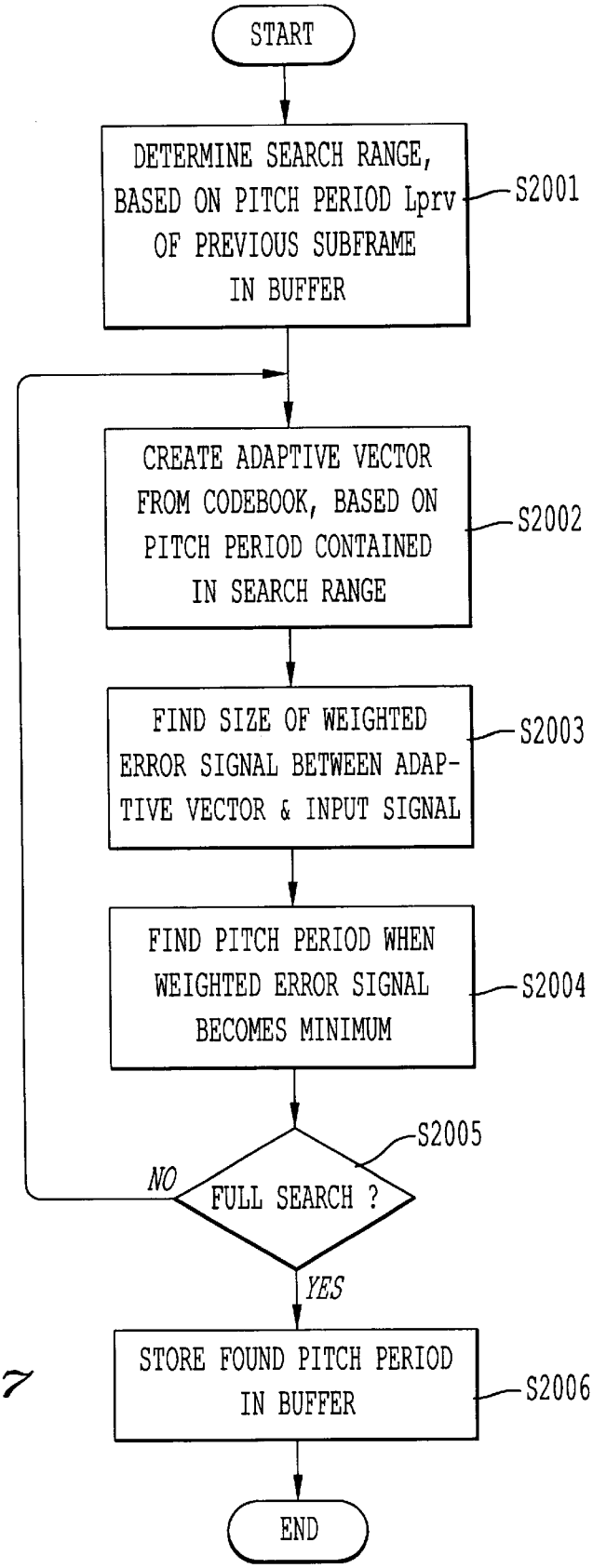
FIG. 7 is a flowchart illustrating the processing performed by the pitch period-calculating portion shown in FIG. 6.

The flow of processing performed by the pitch-calculating portion 102 in accordance with the present embodiment is described now by referring to the flowchart of FIG. 7. In the same way as in the first embodiment, information about the past pitch period Lprv produced from the output terminal 103 is stored in the buffer 203. The search range-determining portion 202 determines a range searched to find the pitch period, based on the past pitch period Lprv (step 2001).

Then, an adaptive vector is taken from the adaptive codebook 201, based on the pitch period contained in the pitch period search range determined in this way (step 2002). The degree of a weighted error signal between this adaptive vector and the input speech signal is found (step 2003). The degree of the weighted error signal is directly found in the manner described below.

That is, the multiplier 204 produces the product of the adaptive vector taken from the adaptive codebook 201 and an optimal gain $g_{opt}$. The output signal from the multiplier 204 is passed through the weighting synthesis filter 205 to produce a synthesis signal. The input speech signal applied from the input terminal 101 is passed through the perceptual weighting filter 207. The subtractor 206 produces the difference between the output signal from the perceptual weighting filter 207 and the output signal from the weighting synthesis filter 205. The distortion-calculating portion 208 calculates the power (distortion) of the differential signal from the subtractor 206 to find the magnitude of the weighted error signal.

LPC parameters are found by a linear predictive coding (LPC) parameter analyzer portion (not shown). The perceptual weighting filter 207 and the weighting synthesis filter 205 are set up according to these LPC parameters. A method of simplifying this search processing has been reported. in practice. Since the reported method is not directly associated with the present invention, it is not described herein.

The distortion-calculating portion 208 finds a pitch period at which the weighted error signal is minimized (step 2004). Then, a decision is made as to whether the whole search range has been searched to find pitch period candidates (step 2005). If the result of the decision is NO, processing starting with step 2002 is immediately performed about remaining candidates. If fall search is done, information about a pitch period that minimizes the magnitude of the weighted error signal is produced from the output terminal 103. At the same time, information about the found pitch period is stored in the buffer 203 for processing of the next subframe (step 2006).

In searching for the pitch period, the search range is narrowed where the past pitch period, i.e., the pitch period of the previous subframe, is short as described in connection with FIG. 5 in the same way as in the first embodiment. Where the pitch period of the previous subframe is long, the search range is enlarged. Thus, the amount of calculation performed by a speech encoding system having an adaptive codebook as in the present embodiment can be reduced.

Third Embodiment

Figure 8:
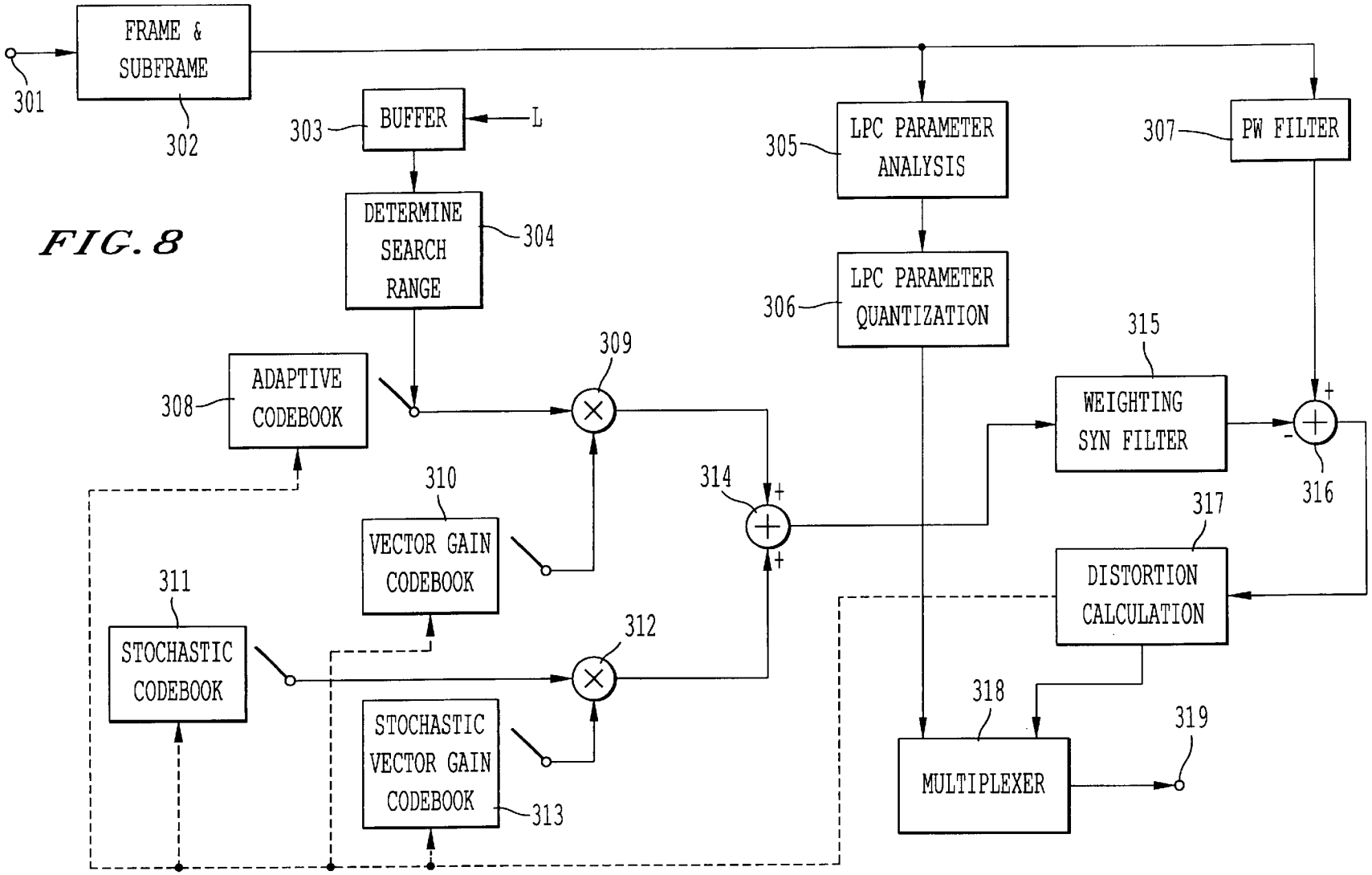
FIG. 8 is a block diagram of a speech-encoding system utilizing a speech-encoding method in accordance with a third embodiment of the invention.

FIG. 8 shows the structure of a speech encoding system in accordance with a third embodiment of the present invention. In the present embodiment, the present invention is applied to a CELP speech encoding system. Note that like components are indicated by like reference numerals in FIGS. 6 and 8. The description given below centers on only the differences with the second embodiment.

A digitized speech signal is applied from a speech input terminal 301. A frame-and-subframe forming portion 302 divides the input speech signal into frames of a predetermined length. Each frame is divided into subframes. The speech signal from the frame-and-subframe forming portion 302 is supplied to an LPC parameter analysis portion 305, which performs an LPC analysis and calculates LPC parameters. These LPC parameters are used to constitute a perceptual weighting filter 307 and a weighting synthesis filter 315.

The LPC parameters found by the LPC parameter analysis portion 305 are quantized by an LPC parameter-quantizing portion 306. The resulting LPC parameter indices are supplied to a multiplexer 318. LPC parameters decoded after the quantization are used to form the weighting synthesis filter 315.

Information about the past pitch period Lprv is stored in the buffer 303. A search range-determining portion 304 determines a search range based on the past pitch period Lprv. An adaptive vector is taken from an adaptive codebook 308, based on pitch periods contained in the search range. Thus, the adaptive vector is created. The present embodiment is similar to the second embodiment in these respects. A multiplier 309 produces the product of the adaptive vector and an adaptive vector gain selected from the adaptive vector gain codebook 310. Another multiplier 312 similarly produces the product of a stochastic vector selected from a stochastic codebook 311 and a stochastic vector gain selected from a stochastic vector gain codebook 313. An adder 314 produces the sum of the output signal from the multiplier 309 and the output signal from the multiplier 312, thus creating an excitation vector.

The excitation vector created in this way is passed through the weighting synthesis filter 315, thus creating a synthesis vector. A subtractor 316 produces the difference between a target vector obtained by passing a speech signal through the perceptual weighting filter 307 and the synthesis vector. A distortion-calculating portion 317 finds a distortion value, based on the difference signal. The distortion-calculating portion 317 searches for a combination of adaptive vector, adaptive vector gain, stochastic vector, and stochastic vector gain at which the distortion assumes its minimum value. One method of carrying out this search efficiently is to search for adaptive vector, adaptive vector gain, stochastic vector, and stochastic vector gain in turn in each subframe. Another method available is to optimize the adaptive vector gain and stochastic vector gain simultaneously by vector quantization in each subframe.

Indices indicating the adaptive vector, adaptive vector gain, stochastic vector, and stochastic vector gain where the distortion assumes its minimum value are fed to the multiplexer 318. This multiplexer 318 multiplexes an LPC parameter index found by the LPC parameter quantization portion 306, an index indicative of an adaptive vector, an index indicative of an adaptive vector gain, an index indicative of a stochastic vector, and an index indicative of a stochastic vector gain, and produces the multiplexed data as encoded data from an encoded data output terminal 319. Information about a pitch period L derived from the index of the adaptive vector found as described above is stored in the buffer 303 for preparation of the next encoding.

Fourth Embodiment

Figure 9:
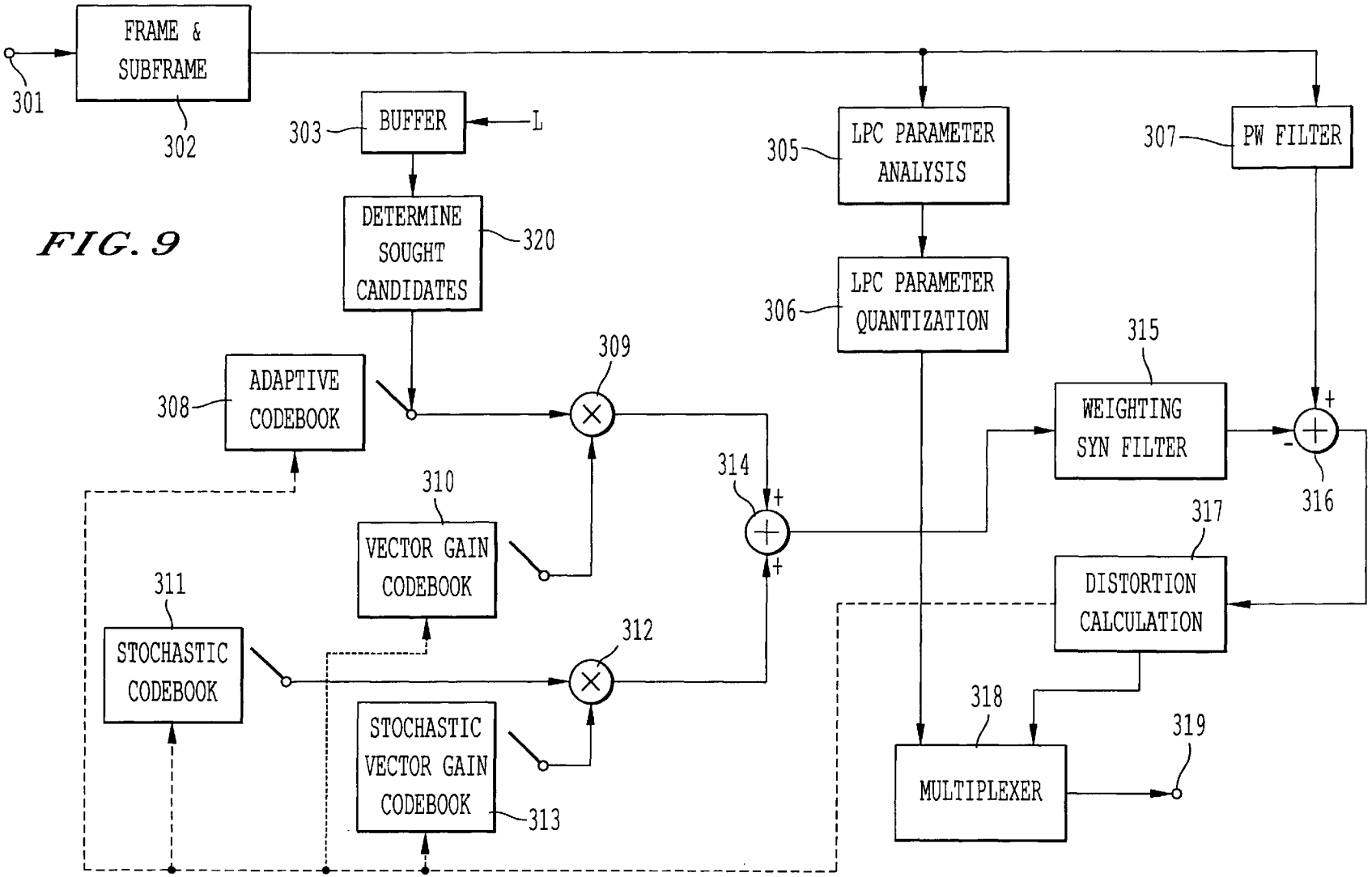
FIG. 9 is a block diagram of a speech-encoding system utilizing a speech-encoding method in accordance with a fourth embodiment of the invention.

FIG. 9 shows the structure of a speech encoding system in accordance with a fourth embodiment of the present invention. Note that like components are denoted by like reference numerals in FIGS. 8 and 9.

The present embodiment is different from the embodiments described thus far in that the pitch period found in the previous subframe is used as a reference and that the amount of deviation from this pitch period is encoded. In this case, the pitch period of the present subframe is encoded with a predetermined amount of code and so the number of pitch period candidates sought in the present subframe remains the same irrespective of the length of the pitch period of the previous subframe. Therefore, in order to vary the pitch period search range in the present subframe according to the length of the pitch period of the previous subframe, it is necessary to vary the intervals between pitch period candidates sought. This will be described in detail by referring to FIG. 10.

In FIG. 9, a sought candidate-determining portion 320 determines sought candidates, based on the pitch period Lprv of the previous subframe, the pitch period Lprv being supplied from the buffer 303. The procedure for the determination is described by referring to FIGS. 10(*a*) and 10(*b*), in which the amount of deviation of the pitch period from the pitch period of the previous subframe is encoded in terms of 3 bits (8 candidates).

Figure 10A:
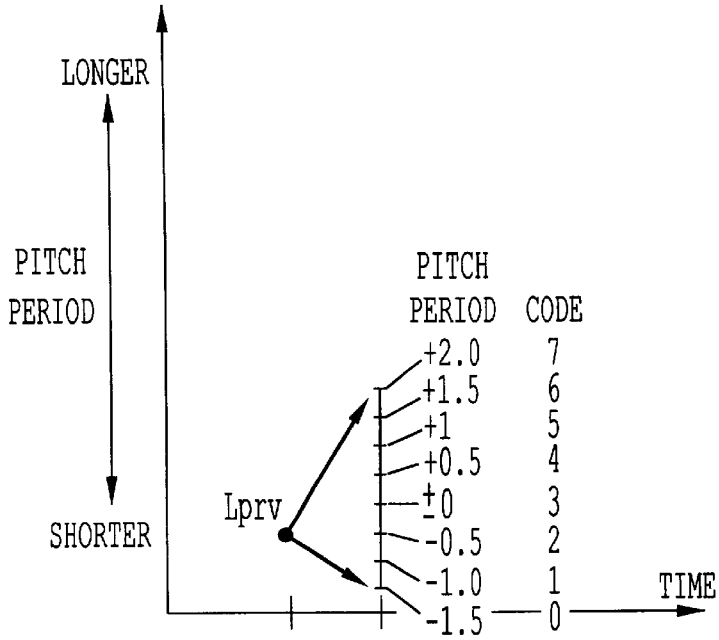
FIGS. 10(*a*) and 10(*b*) are diagrams illustrating a method of determining candidates for a sought pitch period by a search candidate-determining portion in accordance with the fourth embodiment of the invention.
Figure 10B:
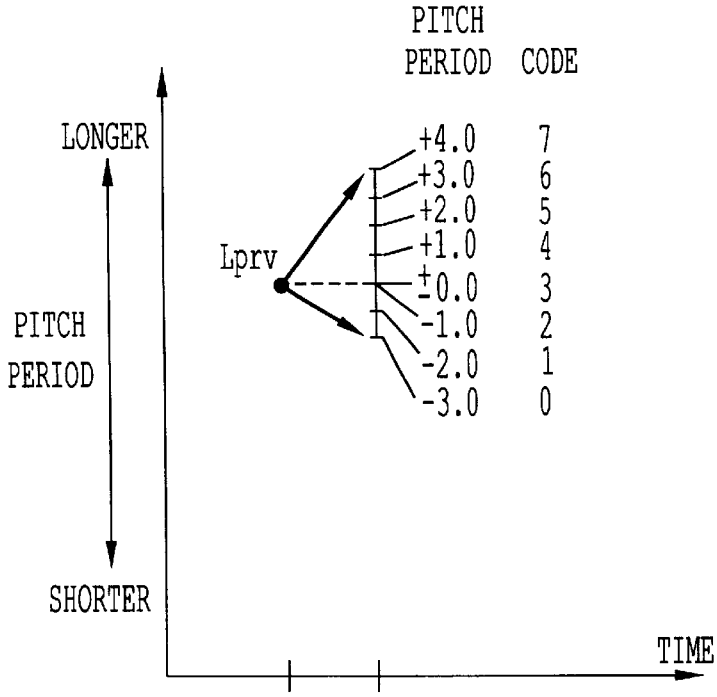

FIG. 10(*a*) shows candidates sought in the present subframe where the pitch period of the previous subframe is short. The candidates are uniformly spaced at intervals of 0.5 sample about the pitch period Lprv of the previous subframe within a given search range of −1.5 to +2.0 samples. Under this condition, the value of the deviation of each candidate from its target signal (i.e., distortion) is calculated in turn. A pitch period producing a minimum distortion is found. If a pitch period of Lprv +0.5 sample is selected, "4" is delivered as a code.

In FIG. 10(*b*), sought candidates in the present subframe where the pitch period of the previous subframe is long are shown in contrast with FIG. 10(*a*). In this case, the candidates are spaced uniformly at intervals of 1 sample about the pitch period Lprv within a given search range of −3.0 +4.0 samples. The pitch period can be efficiently encoded by varying the range searched to find the pitch period of the present subframe and the pitch between the sought candidates according to the length of the pitch period of the previous subframe in this way.

Values of the pitch period have been classified in two categories: short and long. The present invention is not limited to this scheme. For example, values of the pitch period of the previous subframe may be classified into more categories. In each different category, encoding may be done, using a different search range and a different pitch between sought candidates. Consequently, the pitch period can be encoded more efficiently.

In the first subframe in a frame, the pitch period may be encoded independent of the pitch period of the previous subframe. In the following subframes, the amounts of deviation from the pitch period of the previous subframe may be encoded as described above. With this structure, the error immunity can be improved where bit errors occur. That is, when codes representing the pitch period suffer from bit errors, transmission of an erroneous pitch period within a frame can be stopped. This prevents the next frame from being affected.

It is also desired that the continuity of the pitch period is judged, so that only if the pitch period varies continuously, the amount of deviation from the pitch period of the previous subframe is encoded as described in the present embodiment. The correlation between the pitch period of the previous frame and the pitch period of the present frame appears in intervals where the pitch period is stable as in voiced steady portions. For example, this correlation rarely holds in intervals as in the rising part of speech. Consequently, deterioration of the quality in unstable pitch period intervals can be prevented by monitoring the continuity of the pitch period and applying the present embodiment only if the pitch period is continuous.

Fifth Embodiment

Figure 11A:
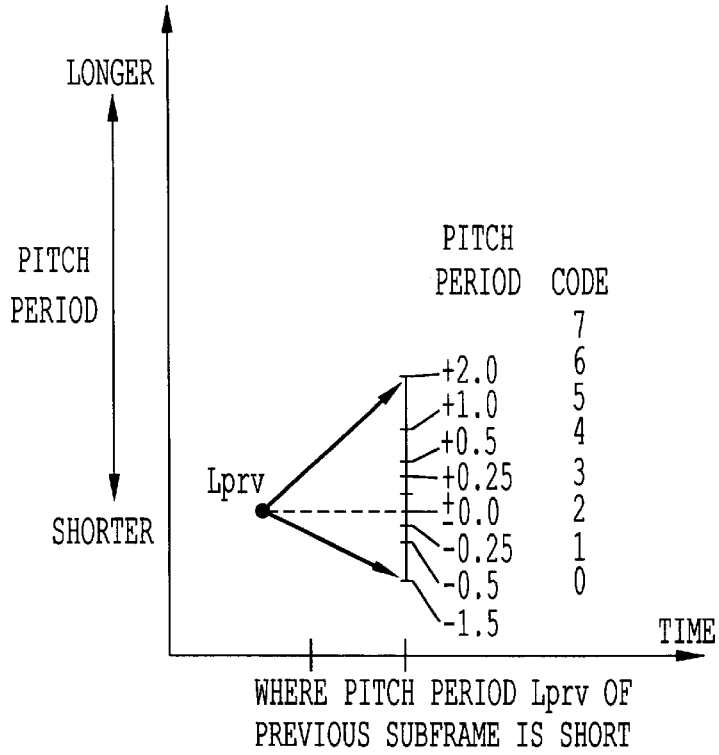
FIGS. 11(*a*) and 11(*b*) are diagrams illustrating a method of determining candidates for a sought pitch period by a search candidate-determining portion in accordance with a fifth embodiment of the invention.
Figure 11B:
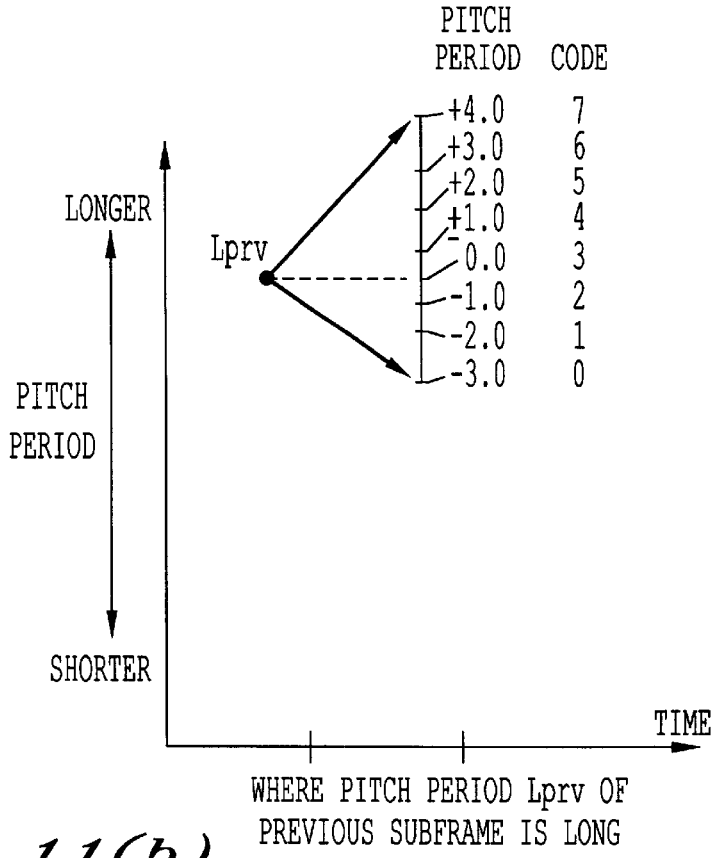

A fifth embodiment of the present invention is next described by referring to FIGS. 11(*a*) and 11(*b*). The present embodiment is a modification of the embodiment in which the amount of deviation of a pitch period from the pitch period found in the previous subframe is encoded. In the fourth embodiment, sought candidates for the pitch period of the present subframe are uniformly spaced from each other within a given search range. The present embodiment is characterized in that sought candidates for the pitch period of the present subframe are arranged at closer intervals where they are close to the pitch period found in the previous subframe and at wider intervals where they are widely different from the found pitch period within the given search range.

This embodiment is now described by referring to FIGS. 11(*a*) and 11(*b*), where the amount of deviation of each pitch period from the pitch period found in the previous subframe is encoded in terms of 3 bits (8 candidates). FIG. 11(*a*) shows sought candidates in the present subframe where the pitch period of the previous subframe is short. The sought candidates are arranged about the pitch period Lprv of the previous subframe within the given search range of −1.5 to +2.0 such that those candidates closer to the pitch period Lprv are spaced more closely and that those candidates widely different from the Lprv are spaced more widely. Under this condition, the amount of deviation of each candidate from a target signal, i.e., a distortion value, is calculated in turn. A pitch period giving rise to a minimum distortion is found. If a pitch period of Lprv−0.25 sample is selected, "2" is delivered as a code. In FIG. 11(*b*), sought candidates in the present subframe where the pitch period of the previous subframe is long are shown in contrast with FIG. 11(*a*). Those sought candidates which are closer to the Lprv are spaced more closely and those which are widely different from the Lprv are spaced more widely within the given search range of −3.0 to +4.0.

In the present embodiment, pitch period candidates in the present subframe are not uniformly arranged within the search range. Rather, they are spaced closely near the pitch period of the previous subframe and spaced widely away from the pitch period of the previous subframe. Hence, the quality of the decoded speech can be improved.

The present embodiment permits modifications similar to the fourth embodiment. For example, values of the pitch period of the previous subframe are not classified into two categories, i.e., short ones and longer ones, but classified into more categories. Encoding may be done using a different search range and a different arrangement of candidates for each different category. As a result, the pitch period can be encoded more efficiently.

In the first subframe in a frame, the pitch period may be encoded independent of the pitch period of the previous subframe. In the following subframes, the amount of deviation of each value of the pitch period from the pitch period of the previous subframe may be encoded. This can improve the error immunity where bit errors take place.

Furthermore, the continuity of the pitch period may be judged. Only if the pitch period is found to vary continuously the amount of deviation of the pitch period from the pitch period of the previous subframe may be encoded as described in the present embodiment.

As described in detail thus far, in the present invention, a range searched to find the pitch period of the present subframe is determined according to the length of the pitch period found in the previous subframe, by making use of the correlation between the length of the pitch period of the previous subframe and the amount of variation in the pitch period between the previous subframe and the present subframe. The quality of the decoded speech is maintained by determining the search range and arranging the sought candidates efficiently. The amount of calculation necessary for the search for the pitch period can be reduced. Furthermore, the quality of the decoded speech can be improved without increasing the amount of code.

What is claimed is:

1. A speech encoding method for encoding an input speech signal with the pitch period of the input speech signal, said method comprising:

dividing the input speech signal into a plurality of frames of a predetermined length and dividing each frame of the input speech signal into a plurality of subframes;

determining a search range searched to find the pitch period of a present subframe to be encoded, according to the length of the pitch period found in a previous subframe prior to the present subframe;

finding the pitch period of the present subframe from the search range; and encoding the pitch period of the present subframe;

wherein:

when the pitch period of the present subframe is found, the search range is searched to find a plurality of candidates for the pitch period of the present subframe;

the candidates that are closer to the pitch period found in the previous subframe are spaced closely to each other; and the candidates that are widely different from the pitch period found in the previous subframe are spaced widely from each other.

2. The speech encoding method of claim 1, wherein the search range is enlarged with increasing the length of the pitch period found in the previous subframe and narrowed with reducing the length of the pitch period found in the previous subframe.

3. The speech encoding method of claim 1, further comprising the steps of:

finding an amount of deviation of the pitch period of the present subframe from the pitch period of the previous subframe; and encoding the amount of deviation as information about the pitch period of the present subframe.

4. A speech encoding method for encoding an input speech signal with the pitch period of the input speech signal, said method comprising:

dividing the input speech signal into a plurality of frames of a predetermined length and dividing each frame of the speech signal into a plurality of subframes;

determining a search range searched to find the pitch period of a present subframe, according to the length of the pitch period found in a previous subframe prior to the present subframe;

taking an adaptive vector from an adaptive codebook according to the pitch period of the present subframe;

passing the taken adaptive vector through a synthesis filter;

searching the adaptive vector that minimizes a difference between an output signal from the synthesis filter and a target vector; and encoding the found adaptive vector;

wherein:

when the pitch period of the present subframe is found, the search range is searched to find a plurality of candidates for the pitch period of the present subframe;

the candidates that are closer to the pitch period found in the previous subframe are spaced closely to each other; and the candidates that are widely different from the pitch period found in the previous subframe are spaced widely from each other.

5. The speech encoding method of claim 4, wherein:

the search range is enlarged with increasing length of the pitch period found in the previous subframe; and the search range is narrowed with reducing length of the pitch period found in the previous subframe.

6. The speech encoding method of claim 4, further comprising:

finding an amount of deviation of the pitch period of the present subframe from the pitch period of the previous subframe; and encoding the found amount of deviation as information about the pitch period of the present subframe.

7. A speech encoding system encoding an input speech signal in accordance with a pitch period of the input speech signal, said speech encoding system comprising:

a) a frame-and-subframe forming portion for dividing the input speech signal into a plurality of frames of a predetermined length and dividing each frame of the speech signal into a plurality of subframes; and b) a search range-determining portion for determining a search range searched to find the pitch period of a present subframe to be encoded, according to the length of the pitch period of a previous subframe; wherein a pitch-calculating portion arranges a plurality of candidates for the pitch period within the search range in such a way that:

1) the candidates that are closer to the pitch period found in the previous subframe are spaced closely to each other, and 2) the candidates that are widely different from the pitch period found in the previous subframe are spaced widely from each other.

8. The speech encoding system of claim 7, wherein the search range-determining portion determines the search range for an adaptive vector taken from an adaptive codebook about the present subframe.

9. The speech encoding system of claim 8, wherein:

the pitch period-calculating portion searches the adaptive vector that minimizes a difference between a filter output signal and a target vector, and the filter output signal is obtained by passing the adaptive vector taken from the adaptive codebook through a synthesis filter.

10. The speech encoding system of claim 9, wherein the pitch period-calculating portion encodes the adaptive vector.

11. The speech encoding system of claim 7, wherein the search range-determining portion sets the search range wider with increasing the length of the pitch period found in the previous subframe and sets the search range narrower with reducing the length of the found pitch period found in the previous subframe.

12. The speech encoding system of claim 7, wherein the pitch period-calculating portion finds an amount of deviation of the pitch period of the present subframe from the pitch period of the previous subframe and encodes the amount of deviation as information about the pitch period of the present subframe.

* * * * *